United States Patent [19]

Iijima

[11] Patent Number: 4,790,776

[45] Date of Patent: Dec. 13, 1988

[54] ELECTRIC POWER PLUG

[75] Inventor: Makoto Iijima, Kawasaki, Japan

[73] Assignee: Kawasaki Electric Wire Co., Ltd., Kanagawa, Japan

[21] Appl. No.: 104,209

[22] Filed: Oct. 5, 1987

[30] Foreign Application Priority Data

Oct. 6, 1986 [JP] Japan ..... 61-153221[U]

[51] Int. Cl.[4] ..... H01R 13/504

[52] U.S. Cl. ..... 439/695; 439/736

[58] Field of Search ..... 439/597-601, 439/606, 693, 695, 697, 736, 904; 264/263, 273

[56] References Cited

U.S. PATENT DOCUMENTS

| | | | |
|---|---|---|---|
| 1,999,020 | 4/1935 | Kollath | 439/598 |
| 2,915,737 | 12/1959 | Morse | 439/695 |
| 3,315,211 | 4/1967 | Weeks, Jr. | 439/736 |
| 3,609,630 | 9/1971 | Francis | 439/736 |
| 3,668,779 | 6/1972 | Turner | 439/736 |

*Primary Examiner*—Gil Weidenfeld
*Assistant Examiner*—Gary F. Paumen
*Attorney, Agent, or Firm*—Armstrong, Nikaido, Marmelstein & Kubovcik

[57] ABSTRACT

The invention is directed to a power plug which has a high physical strength against traction forces tending to pull the blades out of the plug body. The power plug of the invention realizes the above characteristics by comprising a pair of blades, each of the blades having one end connected to a cord, and a blade retaining member. The blade retaining member is made of an electrically insulating material, and has retaining portions which retain the blades so that they are not displaced relative to the blade retaining member. A resin molded plug body embeds the blade retaining member, proximal end portions of the pair of blades at which the blades are connected to the cord, and an end portion of the cord to which the blades are connected.

3 Claims, 5 Drawing Sheets

ELECTRIC POWER PLUG

BACKGROUND OF THE INVENTION

1. Field of the Invention

The present invention relates to an electric power plug. More precisely, the present invention is directed to an electric power plug having increased structural resistance against traction forces tending to pull the blades out of the plug body.

2. Prior Art

Electric power plugs of this type which are available on the market are shown in FIGS. 6(A) and 6(B).

The electric power plug shown in FIG. 6(A) is composed of a pair of blades 1, a cord 2 comprising a pair of conductors connected to proximal end portions of the blades 1 respectively, and a plug body 3. Proximal end portions of the blades 1 are embedded in the plug body 3 together with the adjacent portion of the cord 2 so that the distal end portions of the blades project out of the plug body 3. The proximal end portion of each blade 1 is provided with a through-hole 4, which is filled with the resin material forming the plug body 3. The resin material charged in the through-holes 4 increases the strength of the blades 2 to some extent against traction forces tending to extract the blades 2 out of the plug body 3.

The plug shown in FIG. 6(B) is composed of a pair of blades 1, a cord 2 comprising a pair of conductors connected to the blades 1 respectively, a rectangular core 5 made of a firm resin supporting the pair of blades 1 at their intermediate portions, and a plug body 3 of molded resin. The core 5 is half-embedded in the plug body with one of its surfaces exposed to the outside. The proximal end portions of the blades 1, that is, the portion of the blades 1 inward of the core 5 are embedded in the plug body 3. The blades 1 are retained by the plug body 3 and the core 5.

Traditionally, the physical strength of the plugs was examined by the following test.

The blades 1 of the electric power plug are fixed onto hooks to suspend the plug body 3, as shown in FIG. 7. Then, a prescribed load M is applied to the plug body 3 in the downward direction for a prescribed period of time T. The blades 1 are required to have enough strength to resist this loading without being extruded from the plug body 3.

As to the conventional power plug shown in FIG. 6(A), the blades 1 are retained against the above traction force by virtue of the engagement with the plug body 3 at the through-holes 4 and the friction force acting between the blades 1 and the plug body 3.

As to the conventional power plug shown in FIG. 6(B), the blades 1 are retained against the above traction force mainly by virtue of the engagement and friction force acting between the blades 1 and the plug body 3. Although the core 5 ensures a tight retention of the blades 1 to some extent, it can not and is not intended to ensure a strong retention of the blades 1. The core is intended to improve the appearance of the plug body 3 by exposing the surface of the core 5 rather than to increase the strength.

In recent years however, strength requirements are becoming more stringent. The UL Standard, for example, requires that the displacement of the blades according to above test have to be not larger than 1.6 mm. This is a severe requirement for the above-mentioned conventional power plugs. One possible solution to meet with this requirement may be to increase the hardness and the strength of the material used for the plug body 3. But this solution causes an unexpected inconvenience, that is, the electric cable extending from the plug body 3 becomes liable to be bent in an acute angle at its junction with the plug body 3 due to an abrupt change of the stiffness at that location. This bending may cause a breakage of the conductors.

SUMMARY OF THE INVENTION

In view of the above-mentioned problems in the prior art, the present invention provides an electric power plug having an increased physical strength against tranction forces tending to pull out the blades. The invention realizes this improvement by constructing the plug so as to comprise a pair of blades, a cord which comprises a pair of conductors and an insulation covering the conductors, end portions of the conductors being connected to proximal end portions of the blades respectively, a retaining member made of an electrically insulating material retaining the blades against traction forces, and a plug body molded to cover tightly the retaining member and the portion of the blades and the cord proximal the their connection.

The retaining member clutches hold of the blades by means of the engagement of notches formed on the retaining member and the blades. The notches engage each other to prevent the blades from being displaced from or torn off the retaining member. The retaining member is embedded in the plug body together with the proximate end portions of the blades so as to ensure the engagement. Thus a sufficient strength to withstand the traction forces tending to pull the blades out of the plug body is insured by the present electric power plug.

Description of the Preferred Embodiments

Embodiments of the present invention will now be described in detail with reference to FIGS. 1 to 6.

Figure 1:
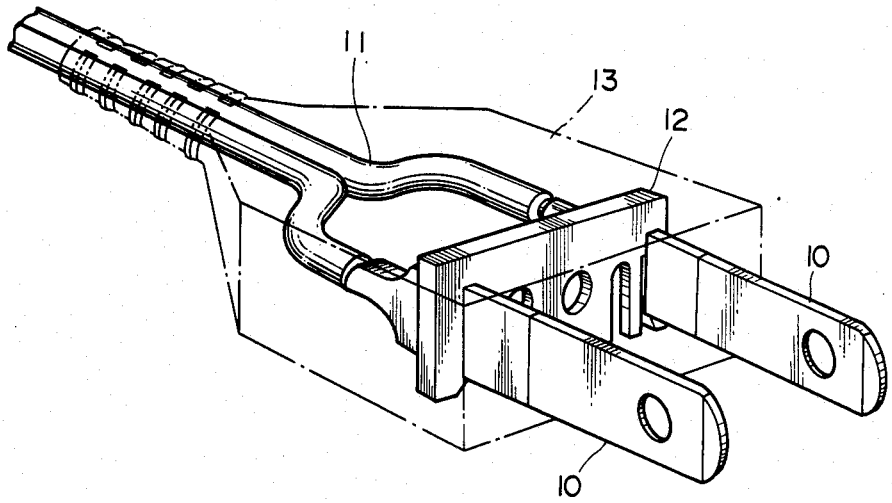
FIG. 1 is a perspective view of an electric power plug according to the present invention.

As shown in FIG. 1, a power plug of the present invention comprises a pair of blades 10, a cord 11 comprising a pair of conductors and an insulation covering the conductors, end portions of the conductors being connected to end portions of the blades 10 respectively, a blade retaining member 12 for retaining the pair of blades 10 in such a manner that they are parallel to each other and they are spaced away from each other at a prescribed interval, and a plug body 13 which is a molded resin in which are embedded the blade retaining member 12, proximal end portions of the pair of blades 10 and proximal end portion of the cord 11.

Figure 2:
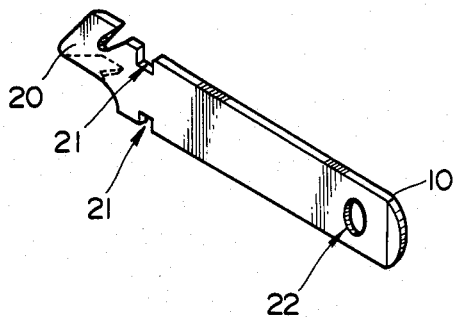
FIG. 2 is a perspective view of a blade to be used in the plug shown in FIG. 1.

As shown in FIG. 2, one end of each blade 10 forms a V-shaped portion 20 for cord connection. When connecting the conductors of the cord 11 to the blades 10, the insulation covering the conductors is pealed off the conductor, then the conductors are connected to the blades 10 respectively. Next, the V-shaped portions 20 are bent around the conductors so as to grasp them tightly. A notch 21 which engages with the blade retaining member 12 is formed in each lateral side edge of the blade 10 in the vicinity of the V-shaped portion 20. A through-hole 22 is formed at the distal end of the blade 10.

Figure 3:
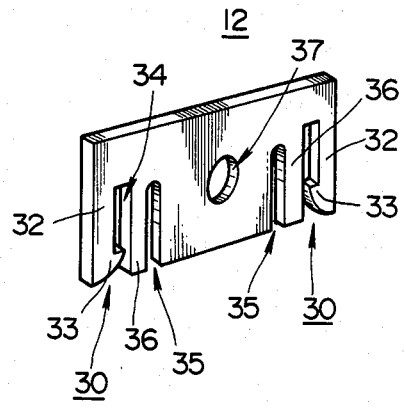
FIG. 3 is a perspective view of a blade retaining member incorporated in the electric power plug shown in FIG. 1 showing the first embodiment of the present invention.

FIG. 3 shows a blade retaining member 12 which comprises a generally rectangular plate made of an electrically insulating resin material such as polypropylene. A pair of blade retaining portions 30 are formed at distal end portions of the blade retaining member respectively. The member is symmetrical with respect to a plane passing through the center of the member 12 and disposed perpendicular to the longer edge.

However, the material of the blade retaining member 12 is not necessarily restricted to resin but may be formed of any electrically insulating material, such as a fiber reinforced plastic, having enough rigidity and being capable of withstanding the temperature of molding, when molded together with the plug body. A through-hole 37 is formed in the central portion of the blade retaining member 12. Two pairs of slits are formed through the blade retaining member 12 and open to one longer edge thereof, so that two pairs of tongues spaced by these slits are provided. The outer tongues are elastic retaining pieces 32, each of which has a lug 33 at its distal end. The lug 33 projects into the fit groove 34 to narrow its open end adjacent to the longer edge and to form a rectangular opening at the inner part of the fit groove 34. The rectangular opening is slightly larger than or substantially equal in dimensions to the notched part 21 of the blade 10 (FIG. 2). At the inner side of the fit grooves 34 are formed a pair of notches 35. That is, a pair of elastic legs 36 (inner tongues) are formed between the pair of fit grooves 34 and the pair of notches 35 respectively.

Figure 4:
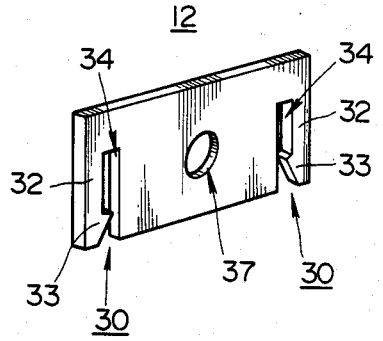
FIG. 4 is a perspective view of another blade retaining member incorporated in the plug shown in FIG. 1 showing the second embodiment of the present invention.

FIG. 4 shows another example of the blade retaining member 12. This blade retaining member 12 has the blade retaining portion at both ends thereof. Each of the blade retaining portions 30 similarly includes an elastic retaining piece 32 with the retaining piece 32 having a projecting lug 33 which is formed at the distal end thereof. The fit groove 34 is a slit formed inwardly in the retaining piece 32. This retaining portion 30 therefore has a simpler structure than that shown in FIG. 3.

The manufacturing procedure for the plug will now be briefly explained according to FIGS. 5(A)–(D) in order to facilitate the understanding of the function of each structure.

Figure 5A:
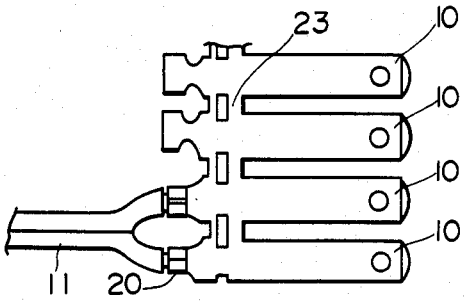
FIGS. 5(A)–5(D) are illustrations showing the manufacturing process of the power plug.

At first, as shown in FIG. 5(A), a sequence of blades 10 are punched out of a metal sheet. At primary stages of the fabrication, a plurality of blades are connected side by side to each other by joint portions 23. A pair of conductors with the insulation covering peeled off at their end portions, are attached respectively to the V-shaped portions 20 of the blades 10. Then the V-shaped portions 20 are bent to hold the conductors tightly.

Figure 5B:
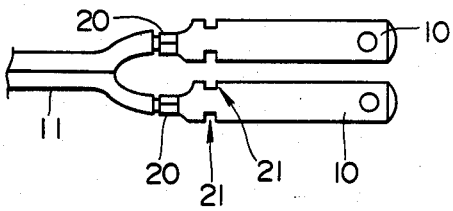

Next, as shown by FIG. 5(B), each blade 10 is cut off from each adjacent blade by removing the joint portions 23 and turned by 90 degrees around the longitudinal axis so as to prepare for a succeeding process.

Figure 5C:
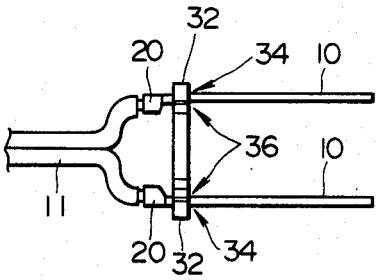

Then, as shown in FIG. 5(C), the blades 10 are inserted by force into the groove 34 of the blade retaining member 12 through the gate. When the blades are inserted by force, the elastic retaining piece 32 and the elastic leg 36 deform elastically so that their distal ends open apart and permit the blades 10 to get inside. When the blade 10 comes to the bottom of the fit groove 34, the blade 10 is supported by the bottom of the groove 34, the tongue, the retaining member 12 and the lug 33. Thus the blades 10 are retained firmly by the retaining member 12.

Figure 5D:
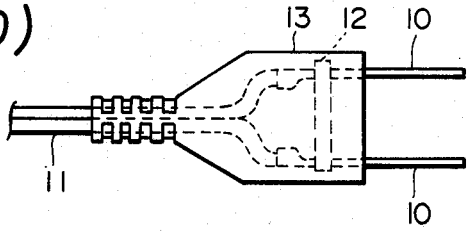
Figure 6A:
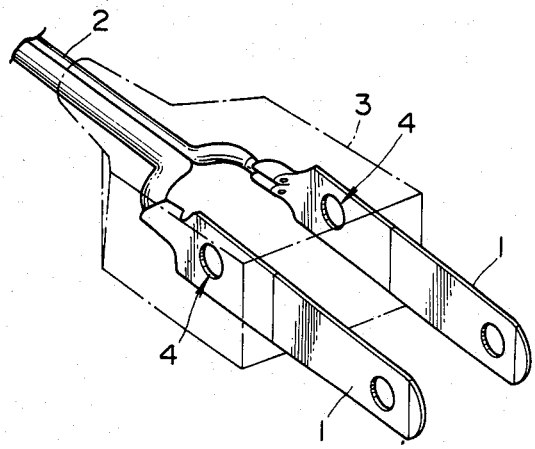
FIG. 6(A) (PRIOR ART)
FIGS. 6(A)–6(B) are perspective views of conventional power plugs.
Figure 6B:
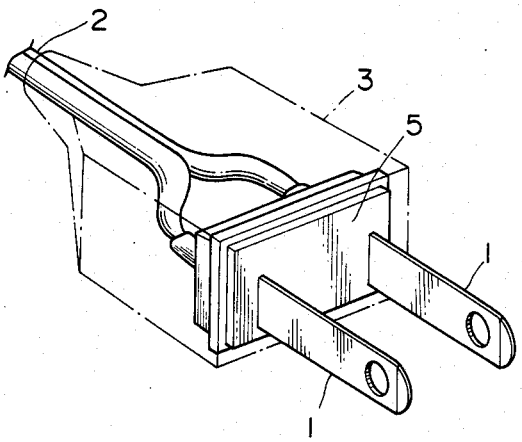
FIG. 6(B) (PRIOR ART)
Figure 7:
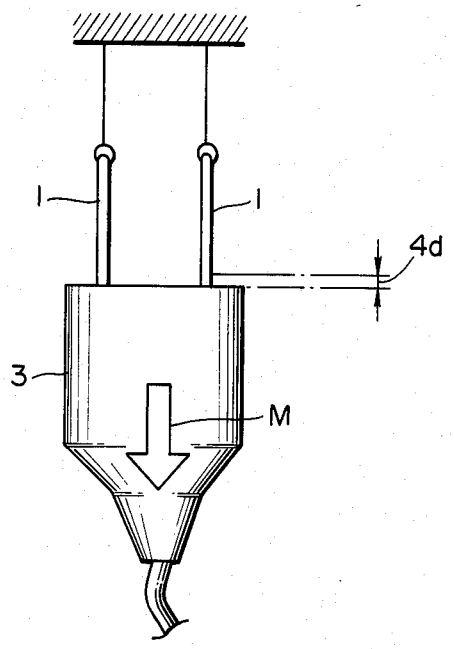
FIG. 7 is an illustration showing a power plug during a pullout test.

Finally, as shown in FIG. 5(D), the assembled members are conveyed into a mold and a plug body is formed around the members by a resin material such as polyvinyl chloride.

The shape and the construction of the member 12 are not limited to those shown in FIGS. 3 and 4 but various modifications are possible. The blade retaining piece 32 may not have the lug 33, since the object of the present invention can be attained without the lugs 33. The blade retaining member 12 is formed by resin molding or by punching.

As explained heretofore, the electric power plug according to the present invention has an improved resistance against a force tending to extract the blades out of the plug body. This is because the blades, being engaged with the blade retaining piece, are molded in the plug body together with the blade retaining member.

What is claimed is:

1. An electric power plug comprising:

a pair of elongated blades with each blade having at least one engaging means formed in a long side of the blade adjacent to one end of the blade for engaging with a blade retaining member;

a blade retaining member made of an electrically insulating material and having a pair of blade engaging portions, each blade engaging portion comprising an outer tongue attached at one end to the blade retaining member and extending perpendicularly to the longitudinal direction of the blade retaining member, said outer tongue defining a slit between an inner side thereof and an opposing side of the blade retaining member, said slit opening to a longer side of the blade retaining member and having a width substantially equal to the thickness of the blade, said engaging portions engaging said engaging means of said pair of blades respectively to retain said blades relative to said blade retaining member;

a cord having a pair of conductors, end portions of said conductors being connected to end portions of said pair of blades respectively; and a plug body made of a resin material with said blade retaining member and portions of said pair of blades in the vicinity of said blade retaining member including the end portions of the blades connected to said cord and said end portions of said conductors embedded in said plug body.

2. An electric power plug according to claim 1, wherein each blade engaging portion further includes an inner tongue extending from said blade retaining member parallel to the outer tongue and defining said slit between an outer side thereof and said inner side of the outer tongue.

3. An electrical power plug according to any one of claims 1 or 2, wherein a lug is formed to project inwardly from an inner side of each outer tongue to narrow the open end of said slit and form a generally rectangular through-hole in said slit, said through-hole having substantially the same dimensions as the dimensions of said engaging means of each blade

* * * * *